United States Patent [19]

Hillman

[11] 4,325,505

[45] Apr. 20, 1982

[54] FLAP HOLSTER

[76] Inventor: Chester K. Hillman, P.O. Box 1272, Twin Falls, Id. 83301

[21] Appl. No.: 155,510

[22] Filed: Jun. 2, 1980

[51] Int. Cl.[3] ..... F41C 33/02

[52] U.S. Cl. ..... 224/238; 224/241; 224/911

[58] Field of Search ..... 224/238, 241, 243, 244, 224/911, 912, 192, 193, 198; D22/13; D2/400

[56] References Cited

U.S. PATENT DOCUMENTS

| | | | |
|---|---|---|---|
| 668,382 | 2/1901 | Martin | 224/241 |
| 1,342,395 | 6/1920 | Rosenquist | 224/234 |
| 1,844,603 | 2/1932 | Sanson | 224/911 X |
| 2,455,635 | 12/1948 | Witte | 224/241 |
| 2,765,968 | 10/1956 | Gaylord, Jr. | 224/911 X |
| 3,688,953 | 9/1972 | Bianchi | 224/192 |
| 3,977,583 | 8/1976 | Bianchi et al. | 224/243 X |

*Primary Examiner*—Allan N. Shoap

*Attorney, Agent, or Firm*—D. A. N. Chase; Michael Yakimo, Jr.

[57] ABSTRACT

A holster for a handgun comprises a case for receiving the handgun and a flap member mounted on the case. The flap member provides a cover member for the handgun having an offset hinge associated therewith. The offset hinge comprises a pair of spaced apart arms extending from the cover member and pivotally mounted to the case to provide for swinging movement of the cover through a path clear of the case between open and closed positions. In the open position the cover member is clear of the top of the case and at an over-center position relative to the axis of pivot so as to be maintained thereat. Snap fasteners, separate from the offset hinge, secure the cover to the case in the closed position to assure a maximum degree of safety, security and protection to the holstered handgun.

5 Claims, 6 Drawing Figures

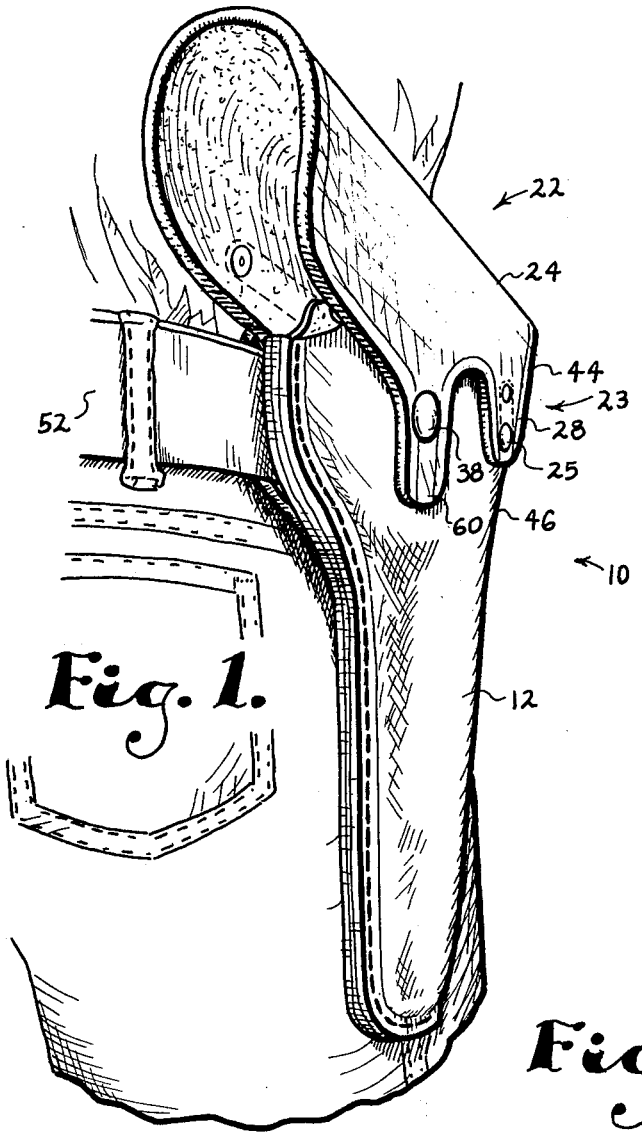
Fig. 1.
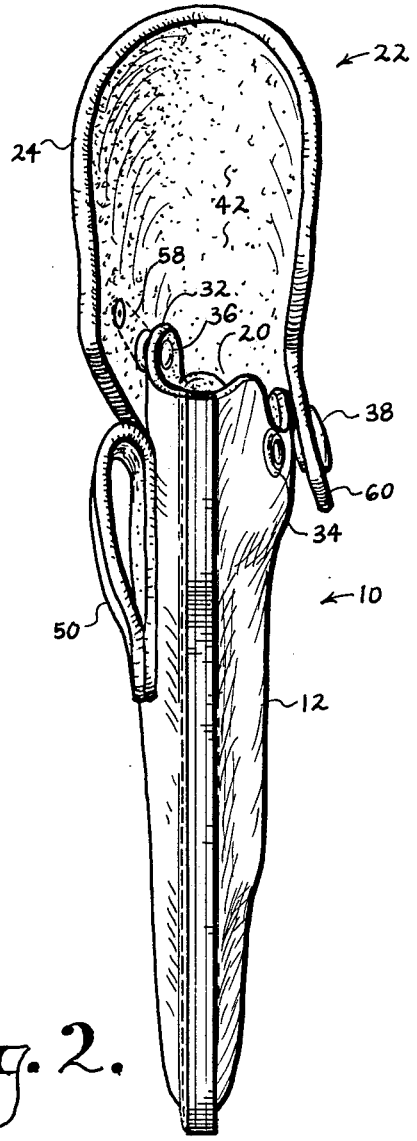
Fig. 2.
Fig. 3.
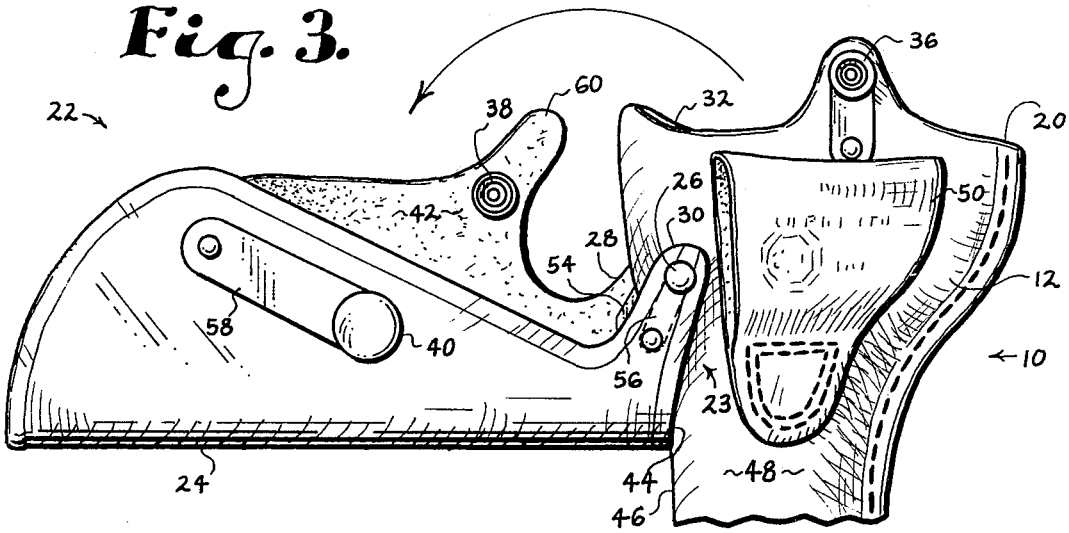

FLAP HOLSTER

BACKGROUND OF THE INVENTION

This invention relates to holsters and more particularly to a flap holster provided with a lockable cover member having an offset hinge associated therewith.

Various known designs of conventional belt holsters for use with handguns or the like have been and are currently in use. Basically, these conventional holsters comprise a body or case member for holding the barrel of the handgun therein with the hammer and handle protruding from the top thereof. In flap holsters, a flap member is attached to the case member to cover the open top portion. The flap member protects the holstered handgun from the elements and holds the handgun in the holster so as to provide safety and security.

The flap member may be of the traditional folding type which is drawn down over the top of the case member and holstered gun and fastened in a closed position. Also, a newer design employs a U-shaped flap member which is pivotally mounted on the case member by opposed snap fasteners used for securing the flap member to the case. The pivotal mount allows the flap member to swing between closed and open positions so as to either cover or expose the holstered handgun.

Inherent with those holsters having a flap member of the traditional type is the relative difficulty of disengaging the flap member from its locked/closed position. Once unlocked, the disengaged flap member interferes with a fast draw, and with reinsertion of the handgun into the case member of the holster.

Furthermore, in newer holster designs employing the pivotable flap member, the desired position of the flap is maintained by interference between adjacent surfaces of the flap and case members. The friction fit thus provided may diminish in its effectiveness during use of the holster due to normal weardown of the interfering adjacent surfaces. Accordingly, undesirable movement of the flap member from a closed position is possible, particularly if the wearer is an active individual, thus decreasing the security, protection and safety offered to the holstered handgun and the shooter.

Also, the use of the snap fasteners as pivots for the flap member inherently allows for some unwanted pivotal movement of the flap member, irrespective of the friction fit, as no positive lock is provided to hold the flap member in the closed position. Such movement can expose the hammer of the handgun to accidental impact, which can discharge a handgun accidentally or mistakenly holstered with the hammer resting on a chambered shell.

The present invention employs a flap member of the pivotable type which comprises a cover member and offset hinge member associated therewith. Snap fasteners, independent of the offset hinge member, are used to lock the cover member at its closed position. The use of the separate offset hinge member allows for the desired pivotable or swinging movement of the cover member between open and closed positions with no significant interference with the case member. The offset hinge member is mounted to the case member at a selected location so as to place the cover member at a substantial over-center position upon movement to the open position and is thus maintained thereat.

It is therefore a general object of this invention to provide a holster having a flap member swingable through open and closed positions.

Another general object of this invention is to provide a holster with flap member, as aforesaid, which is swingable between the open and closed positions with a minimum of interference with other parts of the holster.

Another object of this invention is to provide a holster with flap member, as aforesaid, which has a cover portion and associated offset hinge portion providing for relatively free movement of the cover portion between open and closed positions.

A particular object of this invention is to provide a holster with a member having an offset hinge member, as aforesaid, which is pivotable about a horizontal axis for concurrently guiding the attached cover portion through the desired swingable movement.

Still another particular object of this invention is to provide an offset hinge member, as aforesaid, which is rigidly reinforced to preclude interference with the case member of the holster when mounted thereto.

Still a further object of this invention is to provide a holster with a flap member, as aforesaid, which is swingable to a substantial over-center and open position relative to the axis of pivot to preclude movement of the cover portion of the flap member from its resulting open position.

Another object of this invention is to provide a holster with flap member, as aforesaid, which has separate fastener means associated with said cover portion for locking the cover portion in a closed position.

A still further object of this invention is to provide a holster with flap member, as aforesaid, which is swingable to substantial over-center positions corresponding to open and closed positions for substantial maintenance thereat.

Still another particular object of this invention is to provide a holster with flap member, as aforesaid, having gripping surfaces adjacent the fastener means for facilitation in locking and unlocking the cover portion associated therewith.

A still further object of this invention is to provide a holster with flap member, as aforesaid, which offers a maximum degree of protection, security and safety to the handgun placed therein.

Other objects and advantages of this invention will become apparent from the following description taken in connection with the accompanying drawings, wherein are set forth by way of illustration and example a preferred embodiment of this invention.

BRIEF DESCRIPTION OF THE DRAWINGS

FIG. 1 is a perspective view, taken from the rear thereof, showing the holster attached to the belt of a wearer.

FIG. 2 is a rear view of the holster with the flap member in a closed but unlocked position, the independent snap fasteners being disengaged from their engaged position.

FIG. 3 is a side view of the holster with the lower portion of the case member therein broken away for purposes of illustration, showing the flap member in a substantial over-center and opened position.

DESCRIPTION OF THE PREFERRED EMBODIMENT

Figure 4:
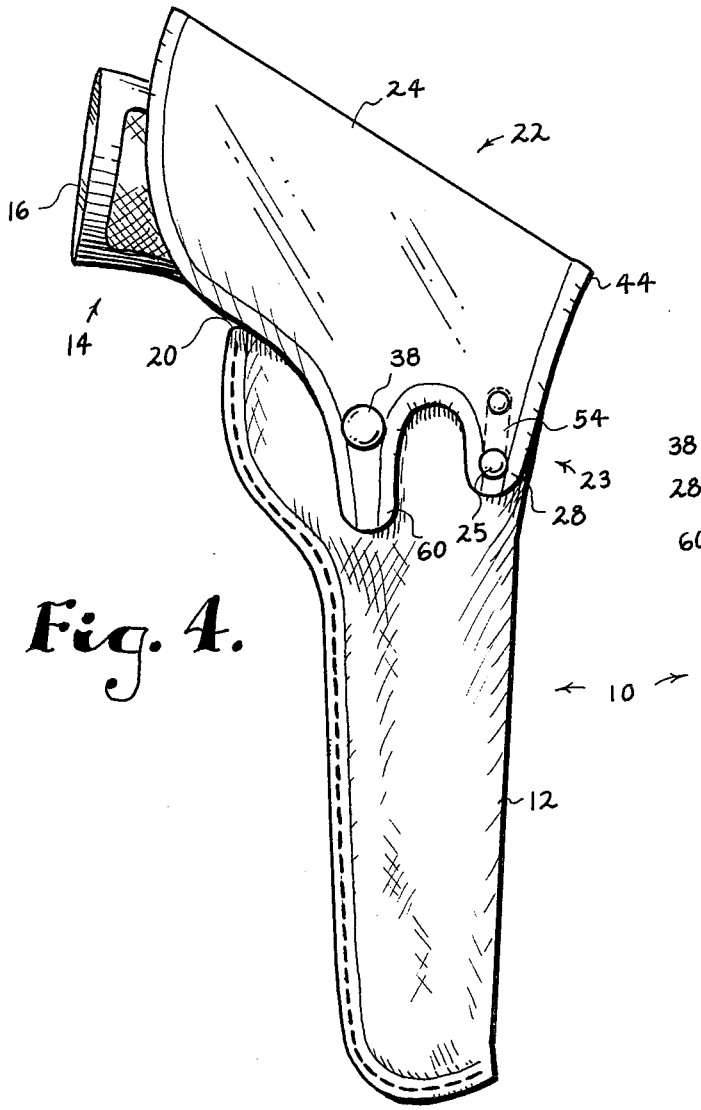
FIG. 4 is a side elevation view of the holster with handgun therein showing the flap member at a closed and locked position.
Figure 5:
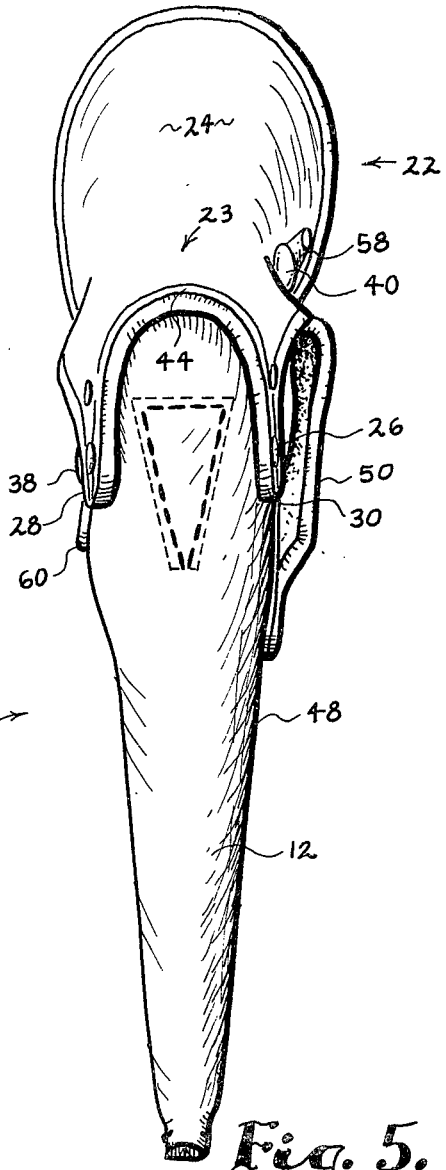
FIG. 5 is a front view of the holster with the flap member being at a closed and locked position.
Figure 6:
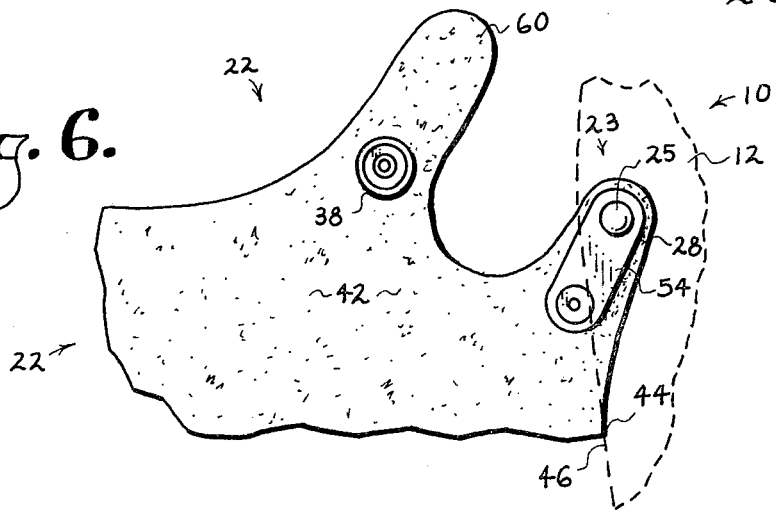
FIG. 6 is a fragmentary interior view showing one of the pivot arms of the offset hinge member mounted to the case member.

Referring more particularly to the drawings, the holster 10 comprises a body/case member 12 preferably made of a leather-like material which is configured to receive the barrel of the handgun 14 upon insertion therein. Accordingly, to facilitate withdrawal of the handgun 14 from its holstered position, the case member 12 is configured to allow the handle 16 and hammer (not shown) of the handgun 14 to protrude from the top opening 20 of the case member 12 as can be seen in FIG. 4.

On the inboard surface 48 of the case member 12 is located a loop 50 for conventional passage of the wearer's belt 52 therethrough to enable the wearer to secure the holster 10 to his person.

A flap member 22 comprises a cover member 24 of a U-shaped configuration and an offset hinge member 23 integral therewith. The cover member 24, in a closed position, overlies the top of the case member 12 and accordingly the handgun 14 placed therein. The offset hinge member 23 comprises first and second spaced apart pivot arms 28 and 30 mounted to opposite sides of the case member 12 for pivotable movement about an imaginary and generally horizontal axis extending through the top front of the case member 12. Tubular rivets 25 and 26 (shown with caps) extending through the arms 28 and 30 and the case member 12 provide pivot points for the respective arms 28 and 30. The offset hinge 23 thus acts as a yoke which guides the cover 24 of the flap member 22 in swingable movement about the aforementioned horizontal axis between an open position as shown in FIG. 3 and a closed position as shown in FIGS. 1, 2, 4 and 5. The offset hinge 23 is preferably located at the front of the cover portion 24 so as to diminish and preferably preclude interference between the hinge 23 and case member 12 as well as with the loop 50, belt 52 and adjacent side of the wearer. This frontal position also allows the mass of the cover member 24 to swing into opposite first and second over-center positions relative to the imaginary horizontal axis extending between the arms 28 and 30, such positions corresponding to the aforementioned closed and open positions.

As shown in FIG. 4, the cover member 24 is at a first over-center and closed position which substantially covers the handle 16 and hammer (not shown) of the handgun 14 placed in the case member 12. Being in such an over-center position the cover member 24 is urged into a downward and counterclockwise position (as viewed in FIG. 4) and is interrupted in this movement by the top free edges 32 of the case member 12. This downward tendency inhibits movement of the flap member 22 in a clockwise direction (as viewed in FIG. 4) during normal movement of the wearer.

Located at the top of the case member 12 and independent of the offset hinge 23 are first and second male fasteners 34 and 36 positioned to engage female fasteners 38 and 40 mounted on the interior surface 42 of the cover member 24. These female fasteners 38 and 40 are aligned with the male fasteners 34 and 36 upon movement of the flap member 22 into the first over-center and closed position. Upon mating engagement between the adjacent fasteners, the cover member 24 is locked at this closed position. The inhibition of swingable movement of the cover member 24, as aided by the first over-center position, cooperates with these separate locking means to assure a maximum degree of safety, security and protection of the handgun 14 placed therein.

Movement of the flap member 22 to the second over-center position as shown in FIG. 3 presents a desired open position prior to removal of the handgun 14. This open position is presented by swinging the flap member 22 in a counterclockwise direction (as viewed in FIG. 3) and is limited by the abutment of the front edge 44 of the flap member 22 against the front surface 46 of the case member 12. As such, the tendency of the flap member 22 to move in a downward arc (counterclockwise) inhibits undesirable contramovement of the flap member 22 from this open position. This tendency cooperates with the positioning of the center of mass of the cover member 24 below the pivot points 25 and 26 for substantial maintenance of the cover 24 thereat. Also of note is that the flap member 22 is below the top edges 32 of the case member 12 which precludes interference of the flap member with the shooter during handgun 14 withdrawal.

Spring-steel reinforcing members 54 and 56 are located along the inside surfaces 42 of the pivot arms 28 and 30 to assure clearance between the pivot arms 28 and 30 and the sides of the case member 12. This clearance allows for free swinging movement of the offset hinge 23 between its open and closed positions and thus enhances the ease of movement of the cover 24 between the open and closed positions. A similar spring-steel reinforcing member is located adjacent the female fastener 40 so as to present a rigid gripping surface to the wearer to facilitate the disengagement of this snap fastener 38 from a similarly reinforced male member 34. An elongated tab 60 extending from the cover 24 contains the outside snap fastener 38 and provides a second gripping surface to the user for facilitation in disengagement of the snap fastener 38 from its locked position.

Having then described the invention, what is claimed as new and desired to be secured by Letters Patent is:

1. A holster for a handgun comprising:

a case member for the handgun having a barrel receiving portion having a longitudinal surface that overlies the top of the barrel when the handgun is holstered;

a flap member having a closed position which substantially covers the top of said case member, said flap member having an end part including portions lying adjacent to and on either side of said longitudinal surface when said flap member is in said closed position;

an offset hinge member for mounting said flap member to said case member and comprising a pair of laterally spaced-apart pivot arms adjacent to and including said portions of said end part to downwardly depend from said flap member in said closed position, said spaced-apart pivot arms having an imaginary horizontal axis of rotation extending therebetween;

pivot means for mounting said pivot arms to said case member adjacent said longitudinal surface with said imaginary horizontal axis extending through said longitudinal surface, said pivot means providing for a swingable movement of said pivot arms to a position downwardly depending from said horizontal axis and generally forward of said case member to concurrently position said flap member in an overcenter position below said horizontal axis of rotation and to the front of said case to substantially maintain said flap member in an open position.

2. The holster as claimed in claim 1, wherein said pivot arms are rigidly reinforced to maintain a displacement of said pivot arms from said case member during said swingable path whereby to diminish interference therebetween.

3. The holster as claimed in claim 1, further comprising at least one fastening means on said flap member rearwardly disposed from said pivot arms for releasably securing said flap member to said case member in said closed position.

4. The holster as claimed in claim 3, wherein the surface of said flap member adjacent to said fastening means is rigidly reinforced to provide a gripping surface thereto whereby to facilitate user operation of said fastening means.

5. The holster as claimed in claim 3, wherein said flap member has a projecting ear-like portion associated therewith, said projecting portion providing a tab for operating said fastening means contained therein.

* * * * *